United States Patent [19]

Haake

[11] 4,264,098

[45] Apr. 28, 1981

[54] MECHANICAL CABLE DISCONNECT DEVICE

[76] Inventor: Frederick L. Haake, 1519 Little Farms Rd., Oxnard, Calif. 93030

[21] Appl. No.: 114,619

[22] Filed: Jan. 23, 1980

[51] Int. Cl.[3] ..... B66C 1/38

[52] U.S. Cl. ..... 294/83 R

[58] Field of Search ..... 294/75, 83 R, 83 A, 294/83 AE, 84; 24/238, 239, 241 SL; 244/137 R, 151 B

[56] References Cited

U.S. PATENT DOCUMENTS

| | | | |
|---|---|---|---|
| 2,368,671 | 2/1945 | Lombard | 294/83 R |
| 2,732,246 | 1/1956 | Bernhart | 294/83 A |
| 2,842,392 | 7/1958 | Haake | 244/151 B X |
| 2,886,368 | 5/1959 | Spratt | 294/83 R |
| 3,066,970 | 12/1962 | Haake | 294/83 A |

FOREIGN PATENT DOCUMENTS

| | | | |
|---|---|---|---|
| 107269 | 10/1924 | Fed. Rep. of Germany | 294/83 R |
| 786865 | 11/1957 | United Kingdom | 294/83 R |
| 643414 | 1/1979 | U.S.S.R. | 294/83 R |

*Primary Examiner*—Johnny D. Cherry
*Attorney, Agent, or Firm*—Ralph B. Pastoriza

[57] ABSTRACT

A mechanical device is provided for disconnecting a load lowered to the ground from the end of a cable in response to engagement of the load with the ground. The device comprises a clevis secured to the end of the cable and provided with a spring-biased pin holding an eye member in turn attached to the load. The weight of the load will hold the pin in the clevis, but when the load engages the ground, the weight of the pin is relieved and the spring will pop the pin out. A slidable member normally blocks outward movement of the pin. A weight releasable from the upper end of the cable is arranged to slide down the cable and strike the slidable member to move it to a position in which the pin is unblocked thereby arming the device for releasing of the load when the load engages the ground.

3 Claims, 4 Drawing Figures

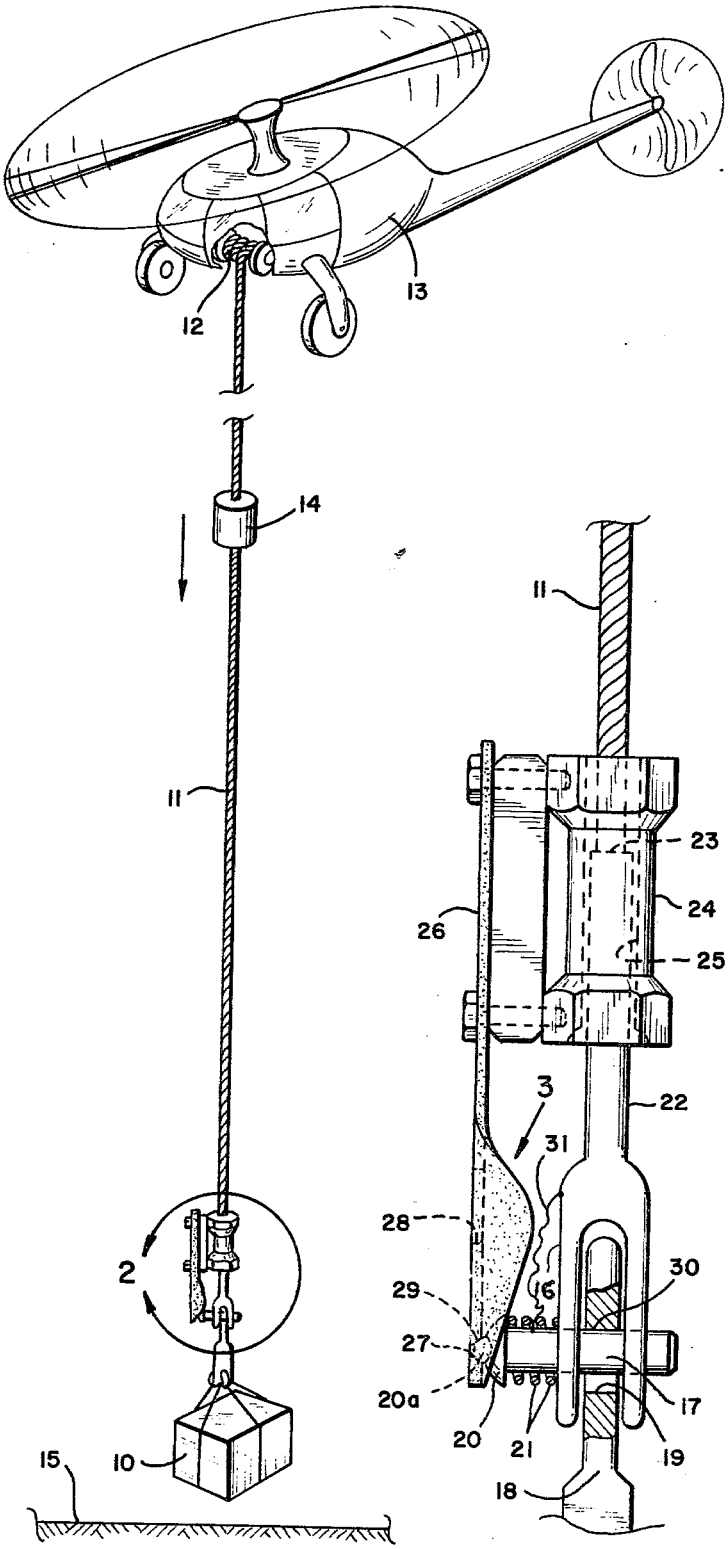
FIG. 1
FIG. 2
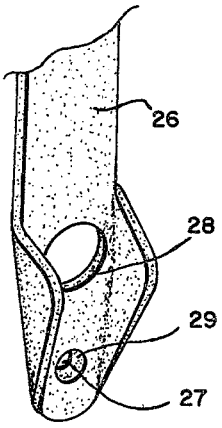
FIG. 3
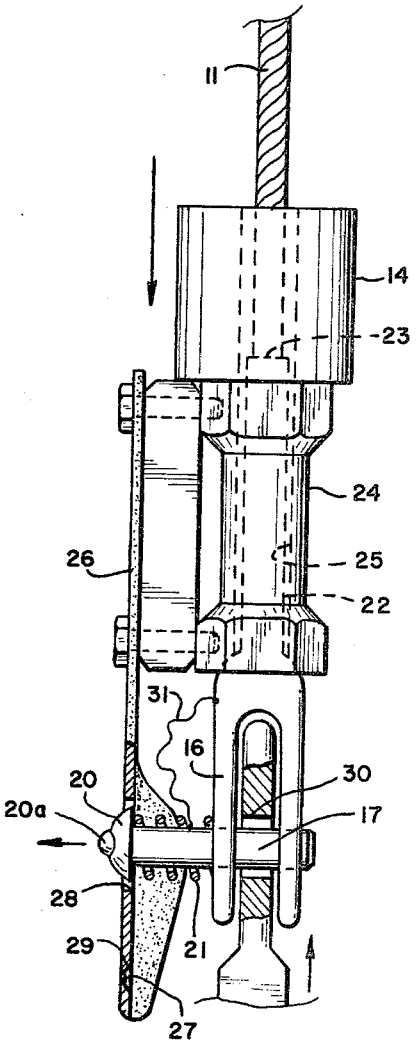
FIG. 4

MECHANICAL CABLE DISCONNECT DEVICE

This invention relates generally to automatic disconnect devices for loads and more particularly to a wholly mechanical device for disconnecting a load being lowered to the ground on the end of a cable.

BACKGROUND OF THE INVENTION

Various types of disconnect or uncoupling devices to separate a load lowered on the end of a cable are known in the art. Certain types of devices constitute "explosive bolts" arranged to be detonated and thereby break a connection between the load and the end of a cable or other structure when it is desired to separate the same. In other instances, electrical devices such as electrically operated locking and unlocking structures which can be controlled from the upper end of a cable are provided to separate or drop a load from the end of a cable. Another class of such devices, purely mechanical in nature, is automatically responsive to engagement of a load with the ground to separate the load from the cable used in lowering the load. Generally these latter type disconnect devices release the load in response to removal of the weight on the device as when the load engages the ground.

Wholly mechanical type devices have certain advantages over chemical or electrically operated devices. First, they are normally less expensive. Second, they can normally be reused. On the other hand, where the connecting device is releasable in response to removal of the weight of the load, inadvertent separation could occur. For example, the weight of the load might be relieved as a consequence of some action other than the load actually engaging the ground, such as a sudden drop in the aircraft supporting the upper end of a cable as a consequence of an air pocket. The resulting momentary relief of tension in the cable on the connecting device could result in inadvertent disconnection while the aircraft and load are still at a high altitude so that the load simply falls to the ground and smashes.

BRIEF DESCRIPTION OF THE PRESENT INVENTION

With the foregoing considerations in mind, the present invention contemplates an improved cable disconnect device of the wholly mechanical type wherein the problems associated with prior mechanical type devices are avoided.

More particularly, in accord with the present invention a mechanical device for disconnecting a load lowered to the ground from the end of a cable includes coupling means holding the load to the end of the cable. An arming means in turn includes means controllable from the upper end of the cable for readying the coupling means to release the load upon the engagement of the load with the ground.

In the preferred embodiment of the invention, this coupling means comprises a clevis with a spring-biased pin holding the load such that when the weight of the load on the pin is relieved, the pin is popped out of the clevis to thereby release the load. The arming means includes a blocking means preventing normal outward movement of the pin. The means controllable from the upper end of the cable, serves to remove the blocking means and thus "arm" the disconnect device for action only when the load engages the ground.

With the foregoing arrangement, inadvertent or unintentional disconnection of the load is prevented and the load can only be released after intentionally "arming" the device.

The entire structure, as stated, is purely mechanical in nature and thus does not require any auxiliary sources of electrical energy or chemical compounds.

BRIEF DESCRIPTION OF THE DRAWINGS

A better understanding of this invention will be had by now referring to a preferred embodiment thereof as illustrated in the accompanying drawings in which:

FIG. 1 is a diagramatic perspective view of a helicopter lowering a load on the end of a cable wherein the load is secured to the end of the cable with the mechanical cable disconnect device of the present invention;

FIG. 2 is an enlarged fragmentary elevational view of the disconnect device portion of the structure enclosed within the circular arrow 2 of FIG. 1, showing various components in a first position;

FIG. 3 is an enlarged fragmentary perspective view of a portion of one of the components looking in the direction of the arrow 3 of FIG. 2; and FIG. 4 is a view similar to FIG. 2, but showing one of the components in a second position preparatory to a disconnection.

DETAILED DESCRIPTION OF THE PREFERRED EMBODIMENT

Referring first to FIG. 1, there is schematically illustrated at the lower portion of the drawing a load 10 connected to the end of a cable 11 for lowering by a winch 12 carried on a helicopter 13. In accord with the present invention, there is provided a mechanical cable disconnect device made up of a coupling means and an arming means. The coupling means with part of the arming means is shown enclosed within the circular arrow 2 of FIG. 1, the remaining portion of the arming means taking the form of a weight 14 slidable on the cable 11 and arranged to be dropped from the helicopter 13 along the cable when it is desired to arm the device.

Essentially, after the device is armed, as will become clearer as the description proceeds, the disconnect will take place in response to the load 10 engaging the ground such as the ground 15 illustrated in FIG. 1.

The manner in which arming and disconnection of the device of this invention takes place will now be better understood by referring to FIG. 2.

In FIG. 2, the referred to coupling means takes the form of a clevis 16 having a cross-pin supporting eye member 18 by eye opening 19. Member 18 is secured to the load 10 of FIG. 1. Pin 17 is provided with an enlarged head 20 at one end outside the clevis 16.

A compression spring 21 is disposed between the outside of the clevis 16 and the head 20 urging the pin 17 out of the eye opening 19 and the clevis. Spring 21 has its one end under the head 20 secured to the head so as to remain captured on the pin.

Pin 17 is prevented from being popped out of the clevis by an appropriate blocking means. This blocking means constitutes part of an arming structure of the device which will now be described.

Referring more specifically to the upper portion of the clevis 16, it will be noticed that the same extends upwardly in a smooth cylindrical portion 22, the extreme upper end thereof being secured to the lower end of the cable 11 as at 23. A slidable member 24 is provided with a central bore 25 surrounding and slidable on the cylindrical portion 22.

Slidable member 23 has secured to one side thereof an arm 26 extending downwardly adjacent to the clevis 16. As shown, the arm 26 has a blocking portion in the form of a bevelled hole 27 engaging the head 20 of the pin 17 and thus holding the pin 17 from being popped out by the compression spring 21. The position of the arm and slidable member 24 as illustrated in FIG. 2 constitutes a first position.

As will become clearer as the description proceeds, this slidable member 24 and arm 26 can be moved downwardly to a second position wherein an opening 28 in the arm 26 is then positioned in registration with the head 20 of the pin 17. The opening 28 is larger than the head of the pin so that the pin is effectively unlocked when the slidable member 24 and arm 26 are moved to the second position. The bevelled portion of the hole 27 is indicated at 29 by the dotted lines in FIG. 2 and serves to cradle the head of the pin to hold the arm from sliding down from its first position to its second position until a positive force is applied.

In the fragmentary perspective view of FIG. 3, the lower portion of the arm 26 defining the hole 27, opening 28 and bevelled portion 29 are clearly illustrated.

Preferably, the head 20 of the pin is provided with a hardened smooth spherical surface portion **20*a* which might constitute a fixed ball bearing. It is actually this portion 20*a* which is cradled in the bevelled hole 27** and provides a smooth surface capable of riding over the bevel when a positive force is applied to the arm to move it from its first to its second position.

It will be appreciated that so long as the components are in the position illustrated in FIG. 2, the load on the eye member 18 is securely held within the clevis 16 by the pin 17.

Referring now to FIG. 4, the slidable member 24 and arm 26 are illustrated in a second position to which the same have been moved upon arming of the device. This arming is accomplished by dropping the heretofore referred-to weight 14 shown in FIG. 1 from the helicopter so that this weight will slide down the cable and strike the slidable member 24 thereby moving the slidable member from the position illustrated in FIG. 2 to a second position as shown in FIG. 4. In this second position, it will now be noted that the opening 28 in the arm 26 is in registration with the head 20 of the pin so that the spring 21 is free to urge the pin 17 out of the eye member and clevis 16.

Referring once again to FIG. 2, it will be noted that the upper portion of the opening 19, designated 30 for the eye member 18, rests in full engagement with the top surface of the pin 17 passing through this opening. The weight of the load pressing on the pin 17 will hold the pin in the clevis 16 even if the arm 26 is removed. However, should the weight be relieved, the spring 21 can then pop out the pin 17 provided it is not blocked by the armed member 26.

Referring now back to FIG. 4, the situation depicted is that which occurs upon engagement of the load 10 of FIG. 1 with the ground. Note that upon engagement, the force of the eye member 18 on the pin 17 is relieved so that the upper portion of the bore in the eye member as at 30 is now spaced from the top of the pin 17 and the spring 21 is fully free to pop out the pin 17 from the clevis 16. This action is possible because the opening 28 of the arm member 26 is in alignment with the head 20 and there is sufficient room for the pin to pass through this opening.

In FIGS. 2 and 4 there is shown a flexible tie string or wire 31 connecting the pin 17 to the clevis 16. This tie string will prevent losing the pin after the same has been popped out so that the components can be reused.

OPERATION

From all of the foregoing, the operation of the mechanical cable disconnect device of this invention will be evident. As already described, the slidable member 24 and arm 26 are initially in the position illustrated in FIG. 2 wherein the pin head portion **20*a* is cradled in the hole 27 so as to be blocked from movement out of the clevis 16**.

With the foregoing arrangement, the load 10 dangling from the end of the cable 11 cannot possibly become inadvertently disconnected from the cable even should the helicopter drop suddenly as might occur when hitting an air pocket. In other words, even if the weight of the load is relieved from the pin 17, the pin 17 cannot be popped out of the clevis by the spring 21 because it is blocked by the arm 26.

As further described heretofore, the arm 26 and slidable member 24 are retained in the first position illustrated in FIG. 2 because of the cradling of the head portion **20*a* of the pin within the bevelled hole 27, there being applied a positive force by the spring 21 which will hold the arm and slidable member in the position illustrated because of the cradling action of the bevel 29**.

Only when it is decided that the load should be ready for disconnection from the cable is the device armed. As described arming takes place by dropping the weight 14 from the helicopter so that it will slide down the cable and strike the slidable member 24 to move it from the first position illustrated in FIG. 2 to the second position illustrated in FIG. 4. In this second position, the pin 17 can now be popped out by the spring 21 after the load 10 has engaged the ground to thereby relieve the weight on the pin 17.

The pin will remain captured to the clevis by the tie string 31 and the spring will remain captured to the pin by its one end connecting to the head. The pin, spring, clevis, slidable member 24 and connecting arm 26 along with the weight 14 can all be hauled up by the winch into the aircraft leaving the eye member 18 and load on the ground. Another load with an appropriate eye member can then be connected to the clevis and the device rearmed and lowered on the end of the cable, the weight 14 being retained in the helicopter until the next load is to be readied for disconnection.

From all of the foregoing it will now be evident that the present invention has provided a greatly improved cable disconnect device which is purely mechanical in nature and yet wherein great reliability is assured in that arming operation is necessary prior to disconnection of the load from the cable.

While a preferred embodiment has been described in connection with the lowering of a load on the end of a cable from a helicopter, it should be understood that the principles can be utilized in any situation wherein it is desired to disconnect the load attached to the end of any type of line or cable in response to the load weight being relieved.

I claim:

1. A mechanical device for disconnecting a load lowered to the ground from the end of a cable including, in combination:

(a) coupling means holding said load to the end of said cable comprising a clevis having a pin holding said load and a spring biasing said pin such that when the weight on said pin is relieved, said pin is popped out by said spring to release the load; and (b) arming means including blocking means for blocking outward movement of said pin; a weight coupled to said cable and positioned to be dropped from the upper portion of said cable for guided movement along the cable, said weight striking said blocking means to move it in a direction to free said pin for outward movement so that said pin is free to be popped out by said spring to release said load in response to engagement of said load with the ground.

2. A mechanical device for holding a load to the end of a cable for lowering by a winch carried on a helicopter, and disconnecting said load from the cable in response to engagement of the load with the ground, said device including, in combination:

(a) a clevis having a cross pin;

(b) an eye member secured to said load and held in said clevis by said cross pin, said cross pin having an enlarged head at one end outside the clevis;

(c) a compression spring between said head and clevis urging said pin out of said eye member and clevis, the weight of said load on said pin by said eye member being sufficient to hold said pin in said clevis against the bias of said spring, said clevis having an upwardly extending smooth cylindrical portion secured to the lower end of said cable;

(d) a slidable member surrounding said cylindrical portion and slidable thereon from a first position toward said clevis to a second position, said slidable member including an arm extending downwardly from one side to engage said head of said pin to hold said pin in said clevis when in said first position, said arm disengaging said head when in said second position, the force exerted by said spring on said head against said arm holding said slidable member in said first position; and (e) a weight coupled for movement along said cable and releasable at the upper end of said cable adjacent to said winch to move down said cable and strike said slidable member when it is desired to ready said load for disconnection, said weight moving said slidable member from said first position to said second position upon striking the same whereby after said slidable member is moved to its second position and when said load engages the ground, the weight on said clevis pin is relieved so that said spring can pop out said pin to release said eye member and thereby disconnect said load from said cable.

3. A device according to claim 2, in which said arm includes a first opposing bevelled hole cradling said head of said pin and holding said pin in said clevis when said slidable member is in said first position, said arm further including an opening larger than said head of said pin spaced from said hole at a higher level than said hole, movement of said slidable member to said second position positioning said opening in registration with the head of said pin so that said pin can pop out through said opening when said load engages the ground, said head riding over the bevelled portion of said hole when said slidable member is moved from its first to its second position, said bevelled portion normally cradling said head to prevent inadvertent movement of said slidable member.

* * * * *